US011358384B2

(12) United States Patent
Van Den Brink

(10) Patent No.: US 11,358,384 B2
(45) Date of Patent: Jun. 14, 2022

(54) ASSEMBLY FOR PROCESSING A SUBSTRATE WEB

(71) Applicant: MPS HOLDING B.V., Arnhem (NL)

(72) Inventor: Lambert Dirk Van Den Brink, Südlohn (DE)

(73) Assignee: MPS HOLDING B.V., Arnhem (NL)

( * ) Notice: Subject to any disclaimer, the term of this patent is extended or adjusted under 35 U.S.C. 154(b) by 106 days.

(21) Appl. No.: 16/637,979

(22) PCT Filed: Aug. 10, 2018

(86) PCT No.: PCT/NL2018/050539
§ 371 (c)(1),
(2) Date: Feb. 10, 2020

(87) PCT Pub. No.: WO2019/031967
PCT Pub. Date: Feb. 14, 2019

(65) Prior Publication Data
US 2020/0207073 A1 Jul. 2, 2020

(30) Foreign Application Priority Data
Aug. 10, 2017 (NL) ..... 2019408

(51) Int. Cl.
*B41F 19/00* (2006.01)
*B41F 13/00* (2006.01)
(Continued)

(52) U.S. Cl.
CPC ..... *B41F 19/007* (2013.01); *B41F 13/0024* (2013.01); *B41F 5/24* (2013.01);
(Continued)

(58) Field of Classification Search
CPC ..... B41F 19/007
(Continued)

(56) References Cited

U.S. PATENT DOCUMENTS 5,117,753 A * 6/1992 Mamberer ..... B41F 13/12 101/176
5,505,128 A * 4/1996 van den Brink ..... B41F 7/12 101/219
(Continued)

FOREIGN PATENT DOCUMENTS

CN 101177069 A 5/2008
DE 40 12 396 A1 10/1991
(Continued)

OTHER PUBLICATIONS

International Search Report, issued in PCT/NL201 8/050539, dated Dec. 11, 2018.
(Continued)

*Primary Examiner* — Anthony H Nguyen
(74) *Attorney, Agent, or Firm* — Birch, Stewart, Kolasch & Birch, LLP

(57) ABSTRACT

An assembly of a first and a second printing or converting apparatus is each at least provided with a number of printing or converting modules disposed one after the other in a main direction, through which in use a substrate web can be guided. The first and the second printing or converting apparatuses are respectively provided with a first and a second rail assembly each extending in a main direction next to or above the associated printing or converting modules and over which at least one processing station is movable. The assembly further includes a transfer assembly which is provided with rail assemblies which are configured to move the at least one processing station from the first rail assembly to the second rail assembly and vice versa and to buffer processing stations.

19 Claims, 5 Drawing Sheets

(51) Int. Cl.
*B41F 5/24* (2006.01)
*B41F 7/12* (2006.01)

(52) U.S. Cl.
CPC ..... *B41F 7/12* (2013.01); *B41F 19/001* (2013.01); *B41P 2217/11* (2013.01); *B65H 2801/21* (2013.01)

(58) Field of Classification Search
USPC ..... 101/177
See application file for complete search history.

(56) References Cited

U.S. PATENT DOCUMENTS 5,749,568 A * 5/1998 Reist ..... B65H 1/30 271/157
6,186,064 B1 2/2001 Dufour
2003/0185656 A1* 10/2003 Hansl ..... B65G 1/0435 414/277
2006/0117971 A1* 6/2006 Wientjens ..... B41F 5/24 101/216
2006/0150838 A1* 7/2006 Hollings ..... B41F 31/00 101/180
2008/0110362 A1 5/2008 D'Annunzio
2009/0095172 A1* 4/2009 Madgar ..... B05B 13/0221 101/118
2010/0242767 A1* 9/2010 Hauer ..... B41F 13/0024 101/480
2011/0132215 A1* 6/2011 Bernard ..... B65H 45/225 101/217

FOREIGN PATENT DOCUMENTS

DE 199 19 732 A1 11/1999
DE 10 2004 021 621 B3 5/2005
EP 0 664 212 A1 7/1995
EP 1 920 927 A2 5/2008
GB 2 403 688 A 1/2005
WO WO 2009/071054 A1 6/2009

OTHER PUBLICATIONS

Written Opinion of the International Searching Authority, issued in PCT/NL201 8/050539, dated Dec. 11, 2018.
English translation of the Chinese Office Action and Search Report for Chinese Application No. 201880065290.4, dated Apr. 1, 2021.

* cited by examiner

ASSEMBLY FOR PROCESSING A SUBSTRATE WEB

FIELD

The invention relates to an assembly for processing a substrate web.

BACKGROUND

EP 0 664 212 A1 describes an assembly for processing a substrate web. The known assembly comprises a first printing or converting apparatus which is provided with a number of printing or converting modules disposed one after the other in a main direction, through which in use a substrate web can be guided. Further, the known assembly is provided with a rail assembly which extends in the main direction next to or above the printing or converting modules. Finally, the known assembly is provided with at least one processing station which is movable over the first rail assembly for positioning the at least one processing station at a desired position in the first main direction of the printing or converting apparatus. With the aid of the processing stations, other processing operations may be carried out, examples including a laminating or delaminating operation, a die-cutting operation, applying a hot foil or a cold foil, carrying out a printing operation of a different type than in the printing modules, for example with a screen printing processing station, as well as a multitude of alternative other operations.

In the known printing apparatus, the printing or converting modules disposed one after the other often also include modules that carry out an operation other than a printing operation. Such other operations are sometimes referred to in practice by the term "finishing". It is noted that "finishing" does not exclusively relate to operations taking place after the printing process has taken place. Finishing relates to operations that are carried out on the substrate web but that cannot be regarded as a printing operation. Finishing may also take place in between two printing operations, or prior to the printing operation. The term "converting" is an umbrella term with which both printing operations and "finishing" are denoted. A converting apparatus hence does not necessarily contain printing modules but generally a converting apparatus will contain a combination of printing modules and finishing modules. For this reason, such lines are denoted both by the term printing apparatus and by the term converting apparatus.

GB 2 403 688 A relates to an offset printing press of a totally different type. This offset printing press comprises a central part which comprises a number of plate cylinders and blanket cylinders disposed one above the other. Further, the printing press is provided on either side with inking systems, which are movable over tracks and which can be moved towards the central part and away from the central part. Optionally, the central parts themselves, that is, without the inking systems, may also be arranged to be movable over tracks for exchange of the central parts, for example for the purpose of maintenance. This known apparatus does not involve complete processing modules being moved and exchanged between different printing or converting apparatuses. In fact, either central parts of a printing apparatus are moved, or inking systems, and the latter only very locally. Since, moreover, GB 2 403 688 A relates to a printing apparatus of a totally different type than the closest state of the art which is formed by EP 0 664 212 A1 where complete printing or converting modules are disposed in a horizontal main direction in line one after the other and where a complete processing station is movably disposed on a rail which extends in the main direction, the skilled person will not, starting from EP 0 664 212 A1, come to consult GB 2 403 688 A.

SUMMARY

It occurs regularly that a printer has more than one printing or converting apparatus at its disposal. Each printing or converting apparatus may then be provided with an associated rail system and associated processing stations which are movable over the rail system.

Underlying the invention is the insight that it would be particularly favorable if exchange of processing stations between the different printing or converting apparatuses were possible in a simple manner.

To this end, the invention provides an assembly according to claim 1.

More particularly, the invention provides an assembly for processing a substrate web, wherein the assembly comprises:

- a first printing or converting apparatus which is at least provided with:
  - a number of first printing or converting modules disposed one after the other in a first main direction, through which in use a first substrate web can be guided;
  - a first rail assembly which extends in the first main direction next to or above the first printing or converting modules;

wherein the assembly is further provided with:

- at least one processing station which is movable over the first rail assembly for positioning of the at least one processing station at a desired position in the first main direction of the printing or converting apparatus;

wherein the assembly according to the invention is characterized by:

- a second printing or converting apparatus which is at least provided with:
  - a number of second printing or converting modules disposed one after the other in a second main direction, through which in use a second substrate web can be guided;
  - a second rail assembly which extends in the second main direction next to or above the second printing or converting modules; and wherein the assembly is further provided with:

- a transfer assembly provided with rail assemblies which are configured to move the at least one processing station from the first rail assembly to the second rail assembly and vice versa and to buffer processing stations.

The first and the second main direction extend substantially horizontally.

With the aid of the transfer assembly, processing stations can be exchanged between the first and the second printing or converting apparatus. This can save the purchase of a number of processing stations. In addition, the order of the processing stations on the first rail assembly and the second rail assembly can be changed in that one or more processing stations can be temporarily parked on the rail assemblies of the transfer assembly. This augments the flexibility of carrying out different processing operations in different orders in both the first and the second printing or converting apparatus. The rail assemblies of the transfer assembly also provide the possibility of buffering processing stations, that is, temporarily storing them when they are not needed in one of the printing or converting apparatuses. The exchanging and buffering of processing stations can be carried out quickly and safely without the risky deployment of cranes for removing processing stations from the first and second rail assemblies, which is the usual state of the art procedure to change the order of processing stations on a rail assembly of a printing or converting machine. It is relevant to note that with the assembly according to the invention complete processing stations are moved. This in contrast to the printing system described in document GB 2 403 688 mentioned in the background section, where only either the inking systems of a number of plate cylinder/blanket cylinder assemblies disposed above each other or the central part that comprises the number of plate cylinder/blanket cylinder assemblies disposed above each other, can be moved separately. It is additionally noted here that the inking systems of GB'688 are movable only very locally, namely, away from and towards a central part of one printing apparatus and not between printing apparatuses mutually. There is no movement of a complete processing station involved in GB'688.

In an embodiment, the transfer assembly can comprise at least one carrier rail assembly. The at least one carrier rail assembly then comprises a carrier rail which extends perpendicular to the rails of the first and the second rail assembly and which is situated at a lower level than the rails of the first and/or the second rail assembly. Further, each carrier rail assembly is provided with a processing station carrier which is movable over the carrier rail and which is provided with a rail segment which in a transfer position of the processing station carrier connects to and is in line with the rails of the first and/or the second rail assembly.

With such a carrier rail assembly, a processing station can be removed from the rails of the first or the second rail assembly. To that end, the processing station carrier is brought in the transfer position where the rail segment is in line with the rails of the first or the second rail assembly. Thereupon, the processing station to be removed is moved onto the rail segment of the processing station carrier. After this, the processing station carrier can be moved away over the carrier rail.

Further elaborations of the invention are described in the dependent claims and will hereinafter, with reference to an example which is represented in the figures, be further clarified.

DETAILED DESCRIPTION

Figure 1:
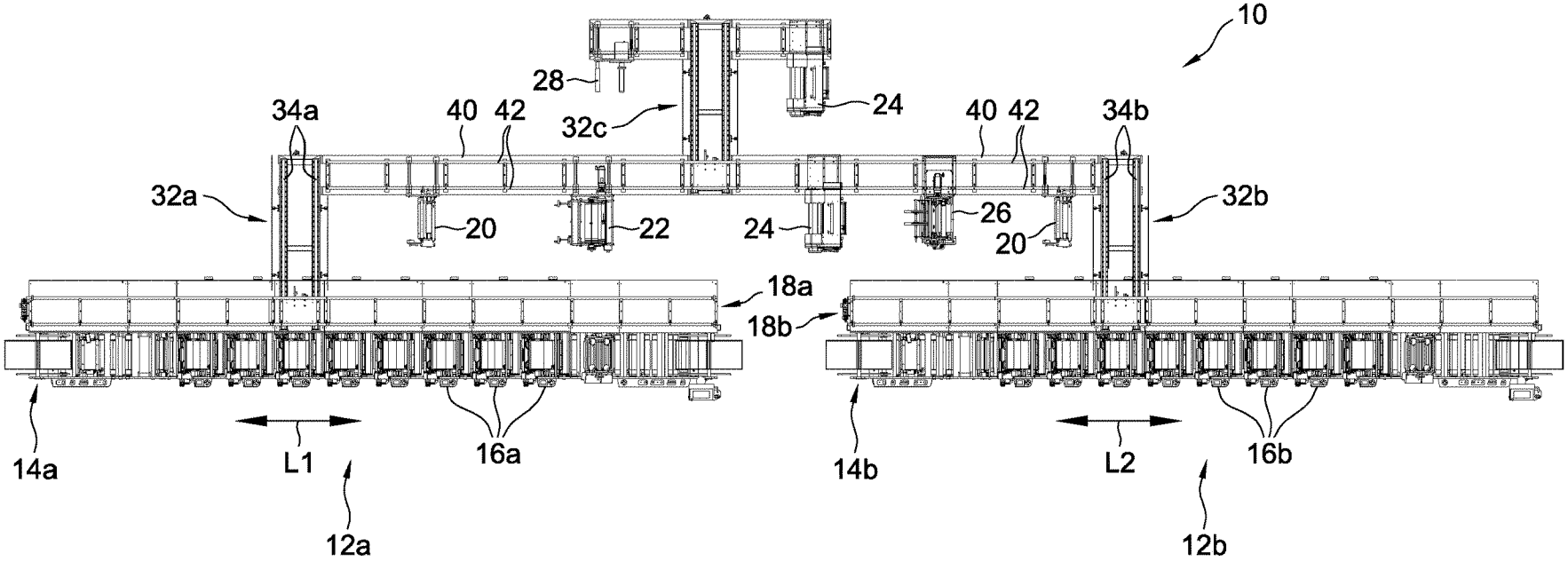
FIG. 1 shows a top plan view of a first example of an assembly according to the invention.
Figure 2:
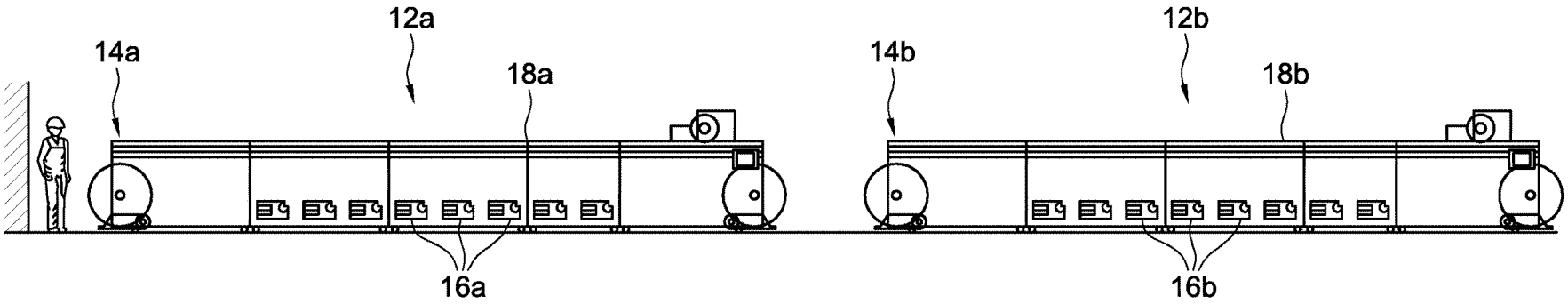
FIG. 2 shows a front view of the top plan view represented in FIG. 1, with omission of the transfer assembly represented in the top plan view of FIG. 1 for the purpose of clarity.

In the following description the reference numerals merely serve for clarification but they have no limiting effect. The embodiments described may also be implemented differently than is represented in the example shown in the figures. The embodiments can be applied independently of each other or in combination with each other In most general terms, the invention provides an assembly 10 for processing a substrate web of which an example is shown in FIGS. 1 and 2 and details in FIGS. 3 and 4. The assembly comprises a first printing or converting apparatus 12*a* which is at least provided with a number of first printing or converting modules 16*a* disposed one after the other in a first main direction L1, through which in use a first substrate web can be guided, and a first rail assembly 18*a* which extends in the first main direction L1 next to or above the first printing or converting modules 16*a*. Optionally, the first printing or converting apparatus 12*a* may be provided with a first unwinding module 14*a*, which forms an upstream end of the first printing or converting apparatus 12*a* or is disposed directly upstream thereof. Further, the assembly 10 is provided with at least one processing station 20-30 which is movable over the first rail assembly 18*a* for positioning of the at least one processing station 20-30 at a desired position in the first main direction L1 of the printing or converting apparatus. The assembly 10 additionally comprises a second printing or converting apparatus 12*b* which, just like the first printing or converting apparatus 12*a*, is at least provided with a number of second printing or converting modules 16*b* disposed one after the other in a second main direction L2, through which in use a second substrate web can be guided, and with a second rail assembly 18*b* which extends in the second main direction L2 next to or above the second printing or converting modules 16*b*. Optionally, the second printing or converting apparatus 12*b* may be provided with a second unwinding module 14*b*, which forms an upstream end of the second printing or converting apparatus 12*b* or is disposed directly upstream thereof. The assembly 10 further comprises a transfer assembly provided with rail assemblies which are configured to move the at least one processing station 20-30 from the first rail assembly 18*a* to the second rail assembly 18*b* and vice versa and to buffer processing stations 20-30.

Such an assembly 10 has the advantages already discussed hereinabove under the heading "SUMMARY" and which are to be considered inserted here.

Figure 5:
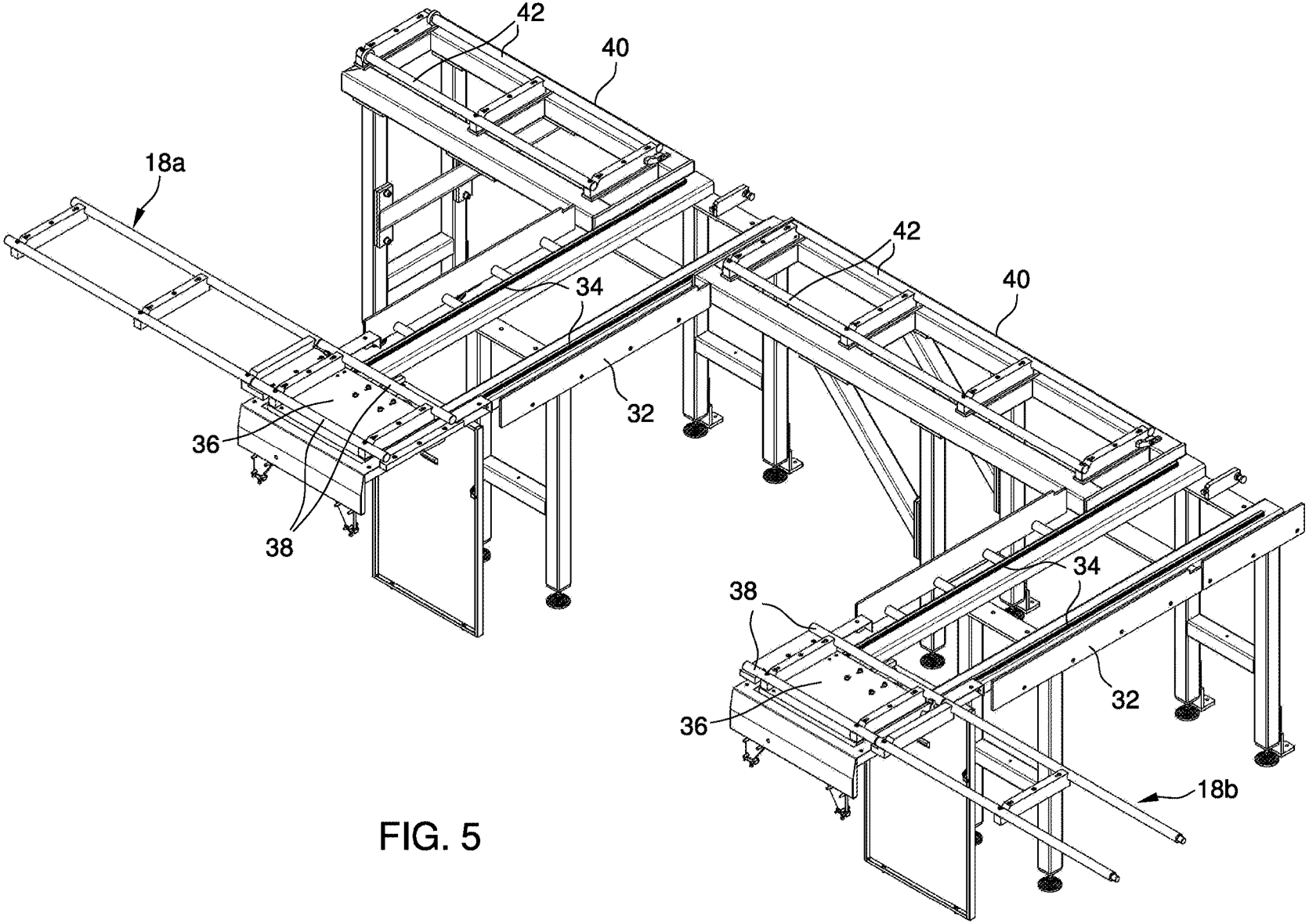
FIG. 5 shows a perspective view of a portion of a first rail assembly, a carrier rail assembly and a buffer rail assembly.

In an embodiment, of which an example is shown in the figures, in particular FIG. 5, the transfer assembly can comprise at least one carrier rail assembly 32. The at least one carrier rail assembly then comprises a carrier rail 34 which extends perpendicular to the rails of the first and/or the second rail assembly 18*a*, 18*b* and which is situated at a lower level than the rails of the first and/or the second rail assembly 18*a*, 18*b*. Further, each carrier rail assembly is provided with a processing station carrier 36 which is movable over the carrier rail 34 and which is provided with a rails segment 38 which in a transfer position of the processing station carrier 36 connects to and is in line with the rails of the first and/or the second rail assembly 18*a*, 18*b*.

With such a carrier rail assembly 32, a processing station 20-30 can be removed from the rails of the first or the second rail assembly 18*a*, 18*b*. To that end, the processing station carrier 36 is brought in the transfer position where the rails segment 38 is in line with the rails of the first or the second rail assembly 18*a*, 18*b*. Next, the processing station 20-30 to be removed is moved on the rail segment 38 of the processing station carrier 36. After that, the processing station carrier 36 can be moved away over the carrier rail 34.

In an embodiment, an example of which is shown in the figures and particularly clearly represented in FIG. 5, the transfer assembly comprises at least one buffer rail assembly 40 which is provided with buffer rails 42 being of the same kind as the rails of the first and the second rail assembly 18*a*, 18*b* of the first printing or converting apparatus 12*a*, 12*b*. The rail segment 38 of the processing station carrier 36, in a transfer position thereof, connects to and is in line with the buffer rails 42.

Thus, a processing station 20-30 situated on the rail segment 38 of the processing station carrier 36 can be transferred on the buffer rail 42 of the buffer rail assembly 40 concerned. The processing station carrier 36 is then free again for receiving a next processing station 20-30 from the first or second rail assembly 18*a*, 18*b*, depending on what the carrier rail 34 is connected to, for example to one rail assembly 18*a* or 18*b*, as shown in the example of FIG. 1, or to two rail assemblies 18*a* and 18*b* as shown in FIGS. 3 and 4.

Figure 4:
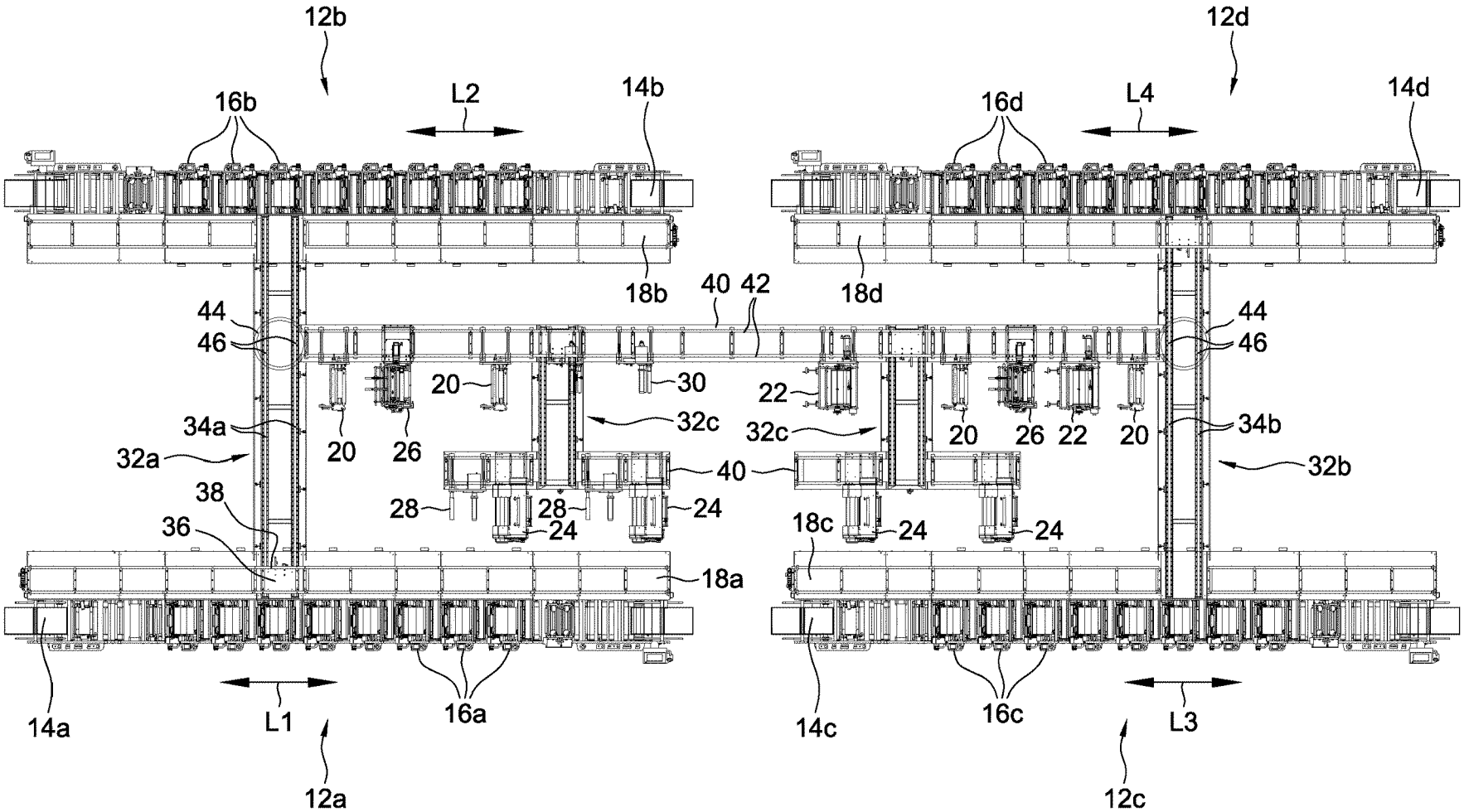
FIG. 4 shows a top plan view of a third example of an assembly according to the invention.

In an embodiment, of which an example is shown in FIGS. 1 and 4, the transfer assembly can comprise two carrier rail assemblies 32*a*, 32*b*. The carrier rail 34*a* of a first 32*a* of the two carrier rail assemblies 32*a*, 32*b* may then connect by one end to the first rail assembly 18*a*. The carrier rail 34*b* of a second 32*b* of the two carrier rail assemblies 32*a*, 32*b* can connect by one end to the second rail assembly 18*b*. Between the two carrier rail assemblies 32*a*, 32*b*, a buffer rail assembly 40 can extend, such that a processing station 20-30 is movable from the first rail assembly 18*a*, via the first 32*a* of the two carrier rail assemblies, the buffer rail assembly 40 and the second 32*b* of the two carrier rail assemblies, to the second rail assembly 18*b* and vice versa.

Such an embodiment affords a great flexibility because there is a considerable space available for the storage of processing stations 20-30 on the buffer assembly 40.

Figure 3:
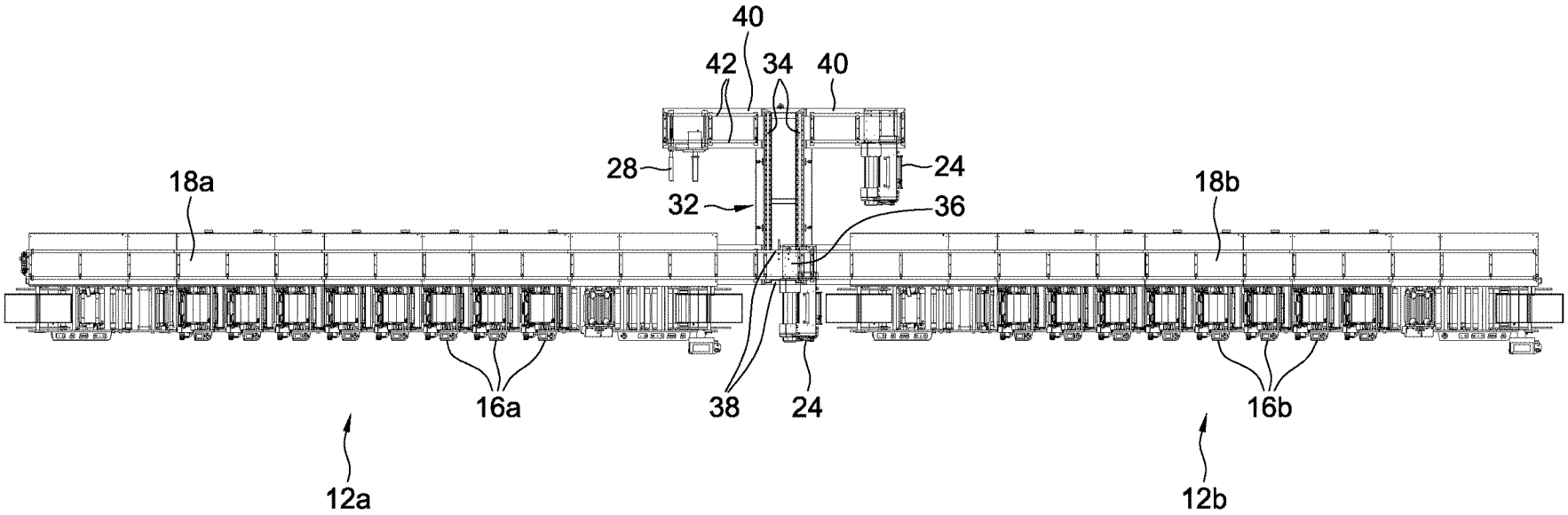
FIG. 3 shows a top plan view of a second example of an assembly according to the invention.

In an alternative embodiment, of which an example is shown in FIG. 3, the transfer assembly may be provided with a single carrier rail assembly 32 and the rails of the first rail assembly 18*a* and the second rail assembly 18*b* can be in line with each other but at a distance from each other. This distance can be bridged by the rail segment 38 of the processing station carrier 36 when this is in a first transfer position, as is visible in FIG. 3. In the example of FIG. 3, connecting to the carrier rail assembly 32 is a buffer rail assembly 40, on which processing stations 20-30 can be stored.

In an embodiment, of which examples are shown in FIGS. 1 and 4, in addition to the at least one carrier rail assembly 32*a*, 32*b*, at least one additional carrier rail assembly 32*c* may connect to the buffer rail assembly 40. Such additional carrier rail assemblies 32*c* may in turn be connected to further buffer rail assemblies 40 in order to thus create more storage space for processing stations 20-30.

In an embodiment, of which an example is shown in FIG. 4, the carrier rail 34*a* of the carrier rail assembly 32*a* can extend from the first rail assembly 18*a* to the second rail assembly 18*b*. The rail segment 38 of the processing station carrier 36 in the first transfer position connects to and is in line with the rail of the first rail assembly 18*a*. In a second transfer position of the processing station carrier 36 the rail segment 38 thereof connects to and is in line with the rail of the second rail assembly 18*b*. In the example of FIG. 4 such a configuration is present twice, since the carrier rail assembly 32*b* likewise extends between two rail assemblies 18*c*, 18*d* of two printing or converting apparatuses. In that example, these two carrier rail assemblies, in turn, are mutually connected by a buffer assembly 40, so that the processing stations 20-30 are exchangeable between four printing or converting apparatuses 12*a*, 12*b*, 12*c*, 12*d* and there is also a considerable space available for buffering of processing stations 20-30.

In an embodiment, of which an example is shown in FIG. 4, the carrier rail assembly 32*a*, 32*b* may be provided with a rail turntable 44. The rail turntable 44 is provided with a carrier rail segment 46 and is configured to rotate the processing station carrier 36 through an angle of 180°. This is of importance because, as is clearly visible in the example of FIG. 4, the rail assemblies 18*a*, 18*b* face each other and the printing or converting apparatuses 12*a*, 12*b* are also operational in opposite direction. At transfer from one rail assembly 18*a* to the other rail assembly 18*b*, the processing stations 20-30 hence have to be rotated through 180° to enable them to be positioned correctly above the printing or converting apparatus concerned.

In an embodiment, of which no example is shown in the figures, there may connect to the carrier rail assembly 32*a*, 32*b* provided with the rail turntable 44 a second carrier rail assembly, whose carrier rail extends perpendicular to the carrier rail 34*a*, 34*b* of the carrier rail assembly 32*a*, 32*b* provided with the rail turntable 44. The rail turntable 44 may then be configured to rotate the processing station carrier 36 through angles of 90°. With such a configuration, there may be connected to the other end of the second carrier rail assembly a printing or converting apparatus, printing or converting modules of which extend in a main direction which includes an angle of 90° with the main direction of the other printing or converting apparatus.

As is clearly apparent from the example that is shown in FIG. 4, the assembly 10, in an embodiment, may further comprise at least one additional printing or converting apparatus 12*c*, 12*d*. Also this additional printing or converting apparatus 12*c*, 12*d* is at least provided with a number of first printing or converting modules 16*c*, 16*d* disposed one after the other in an additional main direction L3, L4, through which in use a first substrate web can be guided, and an additional rail assembly 18*c*, 18*d* which extends in the additional main direction L3, L4 next to or above the additional printing or converting modules 16*c*, 16*d*. Optionally, the at least one additional printing or converting apparatus 12*c*, 12*d* may also be provided with an unwinding module 14*c*, 14*d*. The rail assemblies 32, 40 of the transfer assembly are then further configured to move the at least one processing station 20-30 to the rail assemblies 18*c*, 18*d* of the additional printing or converting apparatus 12*c*, 12*d*.

It will be clear that the network of carrier rail assemblies 32 and buffer rail assemblies 40 may be further expanded and that, further, more additional printing or converting apparatuses may be connected to them, so that an extensive exchange of processing stations 20-30 between the printing or converting apparatuses 12*a*, 12*b*, 12*c*, 12*d*, etc., is possible.

In an embodiment, the printing or converting modules 16*a*, 16*b*, 16*c*, 16*d* of a printing or converting apparatus 12*a*, 12*b*, 12*c*, 12*d* may be selected from the group comprising:

- a flexographic printing module;
- a screen printing module;
- an intaglio printing module;
- an offset printing module;
- a digital printing module, for example with inkjet or with toner;
- a die module;
- a hot foil module;
- a cold foil module;
- a laminating module;
- a delaminating module;
- an unwinding module;
- a rewinding module;
- a substrate reversing module;

an embossing module;
a corona module;
a cross over module; and
a variable data application module.

Also the at least one processing station 20-30 which is movable over a rail assembly 18*a*, 18*b*, 18*c*, 18*d*, 32, 40 may, in an embodiment, be selected from the above-indicated group, in which case the processing operation concerned, of course, is carried out in a processing station 20-30 movable over a rail assembly instead of a module disposed in line in the main direction.

The invention is not limited to the embodiments described and the examples shown. The protection is defined by the following appended claims, in which the reference numerals are merely for clarification and have no limiting effect.

The invention claimed is:

1. An assembly for processing a substrate web, wherein the assembly comprises:
a first printing or converting apparatus, comprising:
a number of first printing or converting modules disposed one after the other in a first main direction, through which in use a first substrate web is capable of being guided; and
a first rail assembly provided with rails extending in the first main direction (L1) next to or above the first printing or converting modules;
at least one processing station movable over the first rail assembly for positioning the at least one processing station at a desired position in the first main direction of the printing or converting apparatus;
a second printing or converting apparatus, comprising:
a number of second printing or converting modules disposed one after the other in a second main direction, through which in use a second substrate web is capable of being guided; and
a second rail assembly provided with rails extending in the second main direction next to or above the second printing or converting modules; and
a transfer assembly comprising rail assemblies configured to move the at least one processing station from the first rail assembly to the second rail assembly and vice versa and to buffer processing stations, the transfer assembly comprising:
a carrier rail extending perpendicular to the rails of the first and/or the second rail assembly, the carrier rail being situated at a lower level than the rails of the first and/or the second rail assembly; and
a processing station carrier moveable over the carrier rail, the processing station carrier being provided with a rails segment, which in a transfer positon of the processing station carrier connects to and is in line with the rails of the first and/or the second rail assembly.

2. The assembly according to claim 1, wherein the transfer assembly comprises:
at least one buffer rail assembly provided with buffer rails being of the same kind as the rails of the first and the second rail assembly of the first printing or converting apparatus, wherein the rail segment of the processing station carrier in a transfer position thereof connects to and is in line with the buffer rails.

3. The assembly according to claim 2, wherein the transfer assembly comprises two carrier rail assemblies, wherein the carrier rail of a first of the two carrier rail assemblies connects by an end to the first rail assembly and wherein the carrier rail of a second of the two carrier rail assemblies connects by an end to the second rail assembly, wherein between two carrier rail assemblies a buffer rail assembly extends, such that a processing station is movable from the first rail assembly, via the first of the two carrier rail assemblies, the buffer rail assembly and the second of the two carrier rail assemblies, to the second rail assembly and vice versa.

4. The assembly according to claim 2, wherein the transfer assembly is provided with one carrier rail assembly and wherein the rails of the first rail assembly and the second rail assembly are in line with each other but at a distance from each other, wherein said distance is bridged by the rail segment of the processing station carrier when is the processing station carrier is in a first transfer position.

5. The assembly according to claim 2, wherein in addition to said at least one carrier rail assembly, at least one additional carrier rail assembly connects to the buffer rail assembly.

6. The assembly according to claim 1, wherein the carrier rail of the carrier rail assembly extends from the first rail assembly to the second rail assembly, wherein the rail segment of the processing station carrier in a first transfer position connects to and is in line with the rail of the first rail assembly and in a second transfer position connects to and is in line with the rail of the second rail assembly.

7. The assembly according to claim 6, wherein the carrier rail assembly is provided with a rail turntable, wherein the rail turntable includes a carrier rail segment and is configured to rotate the processing station carrier through an angle of 180°.

8. The assembly according to claim 7, wherein connecting to the carrier rail assembly provided with the rail turntable is a second carrier rail assembly, the carrier rail of which extends perpendicular to the carrier rail of the carrier rail assembly provided with the rail turntable and wherein the rail turntable is configured to rotate the processing station carrier through angles of 90°.

9. The assembly according to claim 1, further comprising:
at least one additional printing or converting apparatus comprising:
a number of first printing or converting modules disposed one after the other in an additional main direction, through which in use a first substrate web is capable of being guided; and
an additional rail assembly extending in the additional main direction next to or above the additional printing or converting modules,
wherein the rail assemblies of the transfer assembly are also configured to move the at least one processing station to the rail assemblies of the additional printing or converting apparatus.

10. The assembly according to claim 9, wherein the at least one additional printing or converting apparatus is/are provided with an unwinding module forming an upstream end of the additional printing or converting apparatus or being disposed directly upstream thereof.

11. The assembly according to claim 1, wherein the printing or converting modules of said printing or converting apparatus are selected from the group comprising:
a flexographic printing module;
a screen printing module;
an intaglio printing module;
an offset printing module;
a digital printing module, for example with inkjet or with toner;
a die module;
a hot foil module;
a cold foil module;

a laminating module;
a delaminating module;
an unwinding module;
a rewinding module;
a substrate reversing module;
an embossing module;
a corona module;
a cross over module; and
a variable data application module.

12. The assembly according to claim 1, wherein the at least one processing station which is movable over said rail assembly is selected from the group comprising:
a flexographic printing station;
a screen printing station;
an intaglio printing station;
an offset printing station;
a digital printing station, for example with inkjet or toner;
a die station;
a hot foil station;
a cold foil station;
a laminating station;
a delaminating station;
an unwinding station;
a rewinding station;
a substrate reversing station;
an embossing station;
a corona station;
a cross over station; and
a variable data application station.

13. The assembly according to claim 1, wherein the first printing or converting apparatus is provided with a first unwinding module forming an upstream end of the first printing or converting apparatus or being disposed directly upstream thereof, wherein the second printing or converting apparatus is provided with a second unwinding module forming an upstream end of the second printing or converting apparatus or being disposed directly upstream thereof.

14. The assembly according to claim 2, wherein the carrier rail of the carrier rail assembly extends from the first rail assembly to the second rail assembly, wherein the rail segment of the processing station carrier in a first transfer position connects to and is in line with the rail of the first rail assembly and in a second transfer position connects to and is in line with the rail of the second rail assembly.

15. The assembly according to claim 1, further comprising:
at least one additional printing or converting apparatus comprising:
a number of first printing or converting modules disposed one after the other in an additional main direction, through which in use a first substrate web is capable of being guided; and
an additional rail assembly extending in the additional main direction next to or above the additional printing or converting modules,
wherein the rail assemblies of the transfer assembly are also configured to move the at least one processing station to the rail assemblies of the additional printing or converting apparatus.

16. The assembly according to claim 2, further comprising:
at least one additional printing or converting apparatus comprising:
a number of first printing or converting modules disposed one after the other in an additional main direction, through which in use a first substrate web is capable of being guided; and
an additional rail assembly extending in the additional main direction next to or above the additional printing or converting modules,
wherein the rail assemblies of the transfer assembly are also configured to move the at least one processing station to the rail assemblies of the additional printing or converting apparatus.

17. The assembly according to claim 3, further comprising:
at least one additional printing or converting apparatus comprising:
a number of first printing or converting modules disposed one after the other in an additional main direction, through which in use a first substrate web is capable of being guided; and
an additional rail assembly extending in the additional main direction next to or above the additional printing or converting modules,
wherein the rail assemblies of the transfer assembly are also configured to move the at least one processing station to the rail assemblies of the additional printing or converting apparatus.

18. The assembly according to claim 4, further comprising:
at least one additional printing or converting apparatus comprising:
a number of first printing or converting modules disposed one after the other in an additional main direction, through which in use a first substrate web is capable of being guided; and
an additional rail assembly extending in the additional main direction next to or above the additional printing or converting modules,
wherein the rail assemblies of the transfer assembly are also configured to move the at least one processing station to the rail assemblies of the additional printing or converting apparatus.

19. The assembly according to claim 5, further comprising:
at least one additional printing or converting apparatus comprising:
a number of first printing or converting modules disposed one after the other in an additional main direction, through which in use a first substrate web is capable of being guided; and
an additional rail assembly extending in the additional main direction next to or above the additional printing or converting modules,
wherein the rail assemblies of the transfer assembly are also configured to move the at least one processing station to the rail assemblies of the additional printing or converting apparatus.

* * * * *